US012662771B2

(12) United States Patent
Kim et al.

(10) Patent No.: US 12,662,771 B2
(45) Date of Patent: Jun. 23, 2026

(54) OBJECT TREATMENT APPARATUS

(71) Applicant: LG ELECTRONICS INC., Seoul (KR)

(72) Inventors: Daewoong Kim, Seoul (KR); Jeongguen Choi, Seoul (KR); Minkyu Oh, Seoul (KR); Yuna Jo, Seoul (KR); Jaemyung Lim, Seoul (KR); Hyunki Kim, Seoul (KR); Myounghoon Kwak, Seoul (KR); Sung Gul Hwang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 311 days.

(21) Appl. No.: 18/394,073

(22) Filed: Dec. 22, 2023

(65) Prior Publication Data

US 2024/0209561 A1 Jun. 27, 2024

(30) Foreign Application Priority Data

Dec. 22, 2022 (KR) ..... 10-2022-0181586

(51) Int. Cl.
*D06F 58/10* (2006.01)
*D06F 58/24* (2006.01)

(52) U.S. Cl.
CPC ..... *D06F 58/10* (2013.01); *D06F 58/24* (2013.01)

(58) Field of Classification Search
None
See application file for complete search history.

(56) References Cited

U.S. PATENT DOCUMENTS

2021/0222350 A1* 7/2021 Kang ..... D06F 58/10

FOREIGN PATENT DOCUMENTS

KR 10-2014-0108454 9/2014

* cited by examiner

*Primary Examiner* — Rita P Adhlakha
(74) *Attorney, Agent, or Firm* — KED & Associates, LLP

(57) ABSTRACT

The present disclosure provides an object treating apparatus including a cabinet equipped with an inlet defined in a front surface, a door coupled to the cabinet so as to open and close the inlet, a first chamber located inside the cabinet and accommodating therein an object input via the inlet, a second chamber located inside the cabinet and defining therein a space separated from the first chamber, and circulating means positioned inside the second chamber so as to circulate air in the first chamber, wherein the circulating means includes a connection duct equipped with a blowing fan for circulating air and air treating means for treating air, a first flow channel including the connection duct and in communication with the first chamber so as to circulate air in the first chamber, and a second flow channel disposed in the first chamber, including the connection duct, and circulating air in the connection duct during a regeneration process of the air treating means.

20 Claims, 14 Drawing Sheets

(a)

(b)

(a)

(b)

OBJECT TREATMENT APPARATUS

CROSS-REFERENCE TO RELATED APPLICATION(S)

This application claims priority under 35 U.S.C. § 119 to Korean Application No. 10-2022-0181586, filed on Dec. 22, 2022, whose entire disclosure(s) is/are hereby incorporated by reference.

BACKGROUND

1. Field

The present disclosure relates to an object treating apparatus. Specifically, the present disclosure relates to an object treating apparatus that accommodates and displays or manages objects such as clothing or items.

2. Background

An object treating apparatus refers to an apparatus developed to provide an environment with appropriate humidity or the like for an object including items, such as a hat, a scarf, a handkerchief, and a doll, and things, such as a watch and an accessory, as well as normal laundry, to preserve or store the object in an optimal state, and at the same time, display the object.

Korean Patent Application Publication No. 10-2014-0108454 discloses a conventional laundry treating apparatus. That is, in the case of the conventional laundry treating apparatus, a treating room for accommodating the laundry therein and managing the laundry using steam and hot air is defined inside a cabinet, and a hanger bar for hanging the laundry is directed in a left and right direction inside the treating room. A machine room including therein mechanical devices required for the laundry management may be located beneath the treating room to supply the hot air and the steam to the treating room. In addition, when the laundry is hung on the hanger bar using a clothes hanger, the laundry may be directed in a front and rear direction of the cabinet. In addition, a shelf for mounting thereon other articles requiring management, such as a bag and the hat, may be disposed in the treating room.

However, this is an apparatus focused on simply treating and managing the laundry, and has a relatively small space to accommodate the object because the machine room including a heat pump and a steam generator occupies a considerable volume inside the cabinet. In addition, the treating room of the above structure focuses on treating the laundry while simply supplying the steam and dehumidifying, so that it is difficult to store the object while preserving the object in a best condition by providing appropriate temperature and humidity conditions to the article.

In addition, because a hanger reciprocating is disposed inside the treating room in the above-described structure, there is a limitation in placing the shelf for mounting the articles in the treating room having the above-described structure.

In addition, using the treating room for small amounts of laundry may not be energy-efficient. When a front surface of a door is made of a transparent material such that a user may check the laundry hung inside, an insulation performance via the front surface of the door is poor, making it difficult to achieve the purpose of laundry management.

In addition, as laundry and items of various materials develop, when an object that requires delicate management in terms of humidity and temperature, such as a leather product or a silk product, is mounted on the shelf of the above structure, there is a problem in that environmental conditions of the treating room for refreshing the laundry may actually cause the laundry to deteriorate a lifespan thereof, rather than preserving the laundry.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein:

FIG. 14(*b*) is a view showing a flow of air in circulating means via a second flow channel.

FIG. 15(*b*) is a cross-sectional perspective view of (*b*) in FIG. 14.

DETAILED DESCRIPTION

Figure 1:
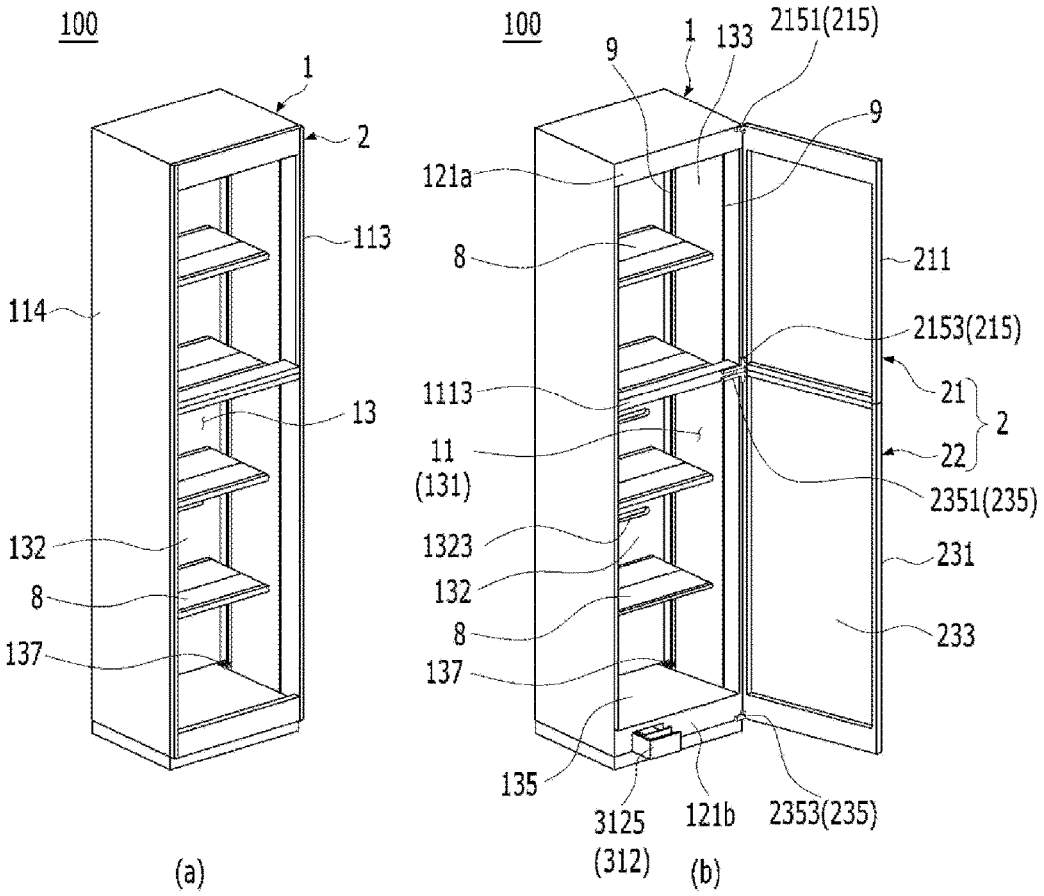
FIGS. 1(*a*) and (*b*) show an example of an object treating apparatus.
Figure 2:
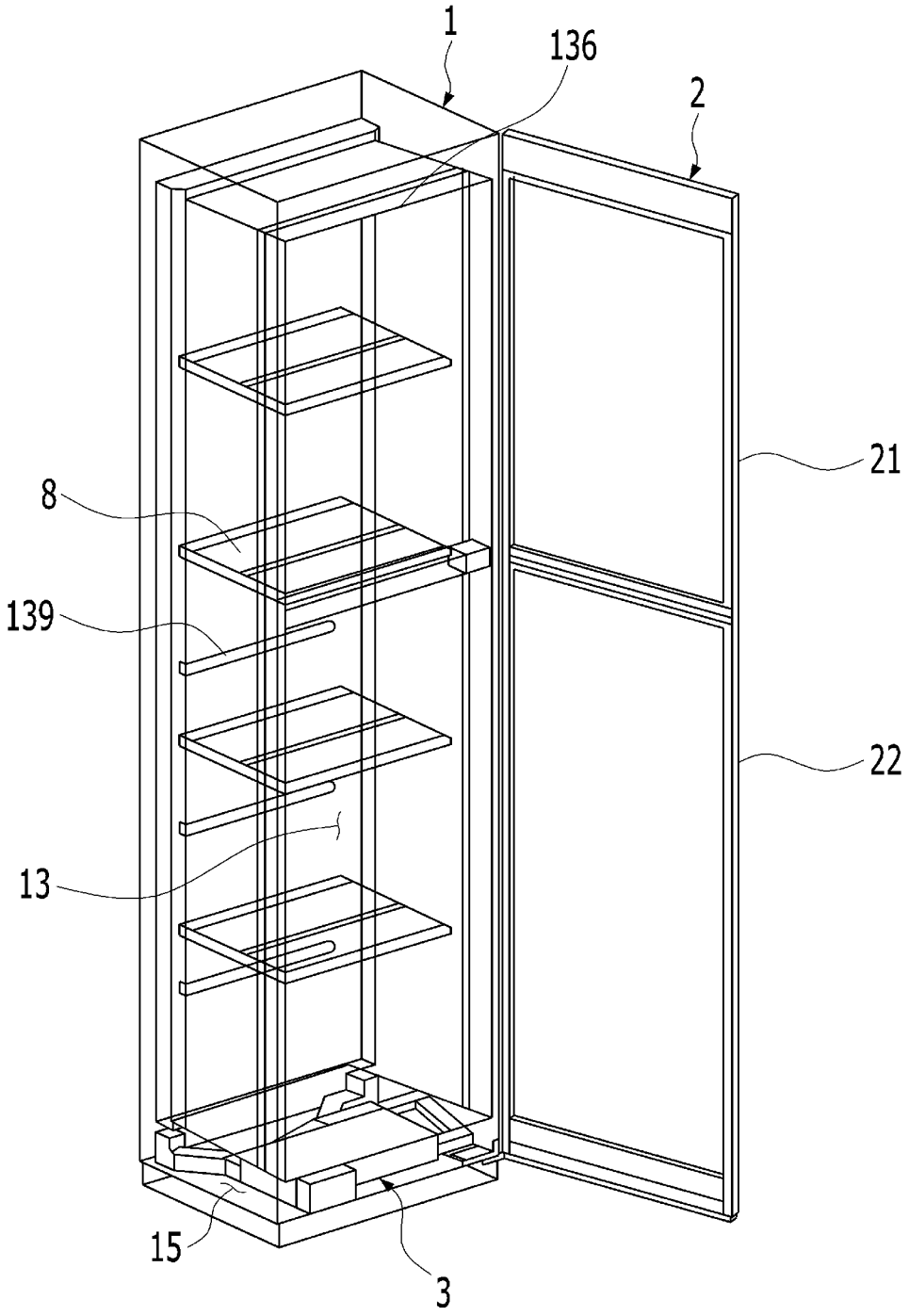
FIG. 2 is a projection view of an object treating apparatus.

Referring to FIGS. 1 and 2, an object treating apparatus 100 of the present disclosure includes a cabinet 1 equipped with an inlet 11 in a front surface thereof, a door 2 coupled to the cabinet 1 so as to open and close the inlet 11, a first chamber 13 located inside the cabinet 1 and accommodating an object introduced via the inlet 11, and a second chamber 15 defining a space separated from the first chamber 13.

The cabinet 1 has the inlet 11 defined in the front surface 121 thereof, and the object is able to be introduced into the cabinet 1 via the inlet 11. An entirety of the front surface 121 of the cabinet 1 may be defined as the inlet 11, or a portion of the front surface 121 may be penetrated to become the inlet 11. When the portion of the front surface 121 of the cabinet 1 is penetrated to become the inlet 11, the front surface 121 may include an upper panel 121*a* disposed on top of the inlet 11 and a lower panel 121*b* disposed beneath the inlet 11.

The first chamber 13 is disposed inside the cabinet 1. A first chamber opening 131 defining a front surface of the first chamber 13 may be defined with the inlet 11. That is, an interior of the first chamber 13 may be accessed via the inlet 11. The first chamber includes a rear surface 132 facing the inlet 11 and disposed at the rear of the inlet 11, a left side surface 133 forming a left side surface among both side surfaces, a right side surface 134 forming a right side surface, a bottom surface 135 forming a bottom surface, and a top surface 136 forming a top surface. The first chamber 13 may accommodate the object introduced via the first chamber opening 131, that is, the inlet 11 in an internal space defined by the first chamber rear surface 132, the first chamber left side surface 133, the first chamber right side surface 134, the first chamber bottom surface 135, and the first chamber top surface 136.

Because the first chamber 13 is a space for accommodating and preserving or storing the object such as the laundry, the items, and the things, the first chamber 13 may also be referred to as a storage room, a preservation room, a treating room, a showcase room, or a receiving chamber.

The second chamber 15 may be defined as a space separated from the first chamber 13. The second chamber 15 may define a space separated downwardly from the first chamber 13 inside the cabinet 1 by the bottom surface 135 of the first chamber 13. Circulating means 3 to be described later may be disposed inside the second chamber 15 to circulate air in the first chamber 13.

Because the second chamber 15 is equipped with a mechanical device to circulate the air in the first chamber 13 and process the air in the first chamber 13, the second chamber 15 may also be referred to as a machine room or an auxiliary chamber.

The door 2 may be pivotably coupled to the cabinet 1 to open and close the inlet 11. The door 2 may be coupled to the cabinet in a hinge manner so as to be pivotable or rotatable. The door 2 may be coupled to the cabinet 1 from the front so as to open and close the inlet 11. In this regard, a center of gravity of the door 2 moves forwardly of the cabinet 1 while the door 2 is opened.

In this structure, when the door 2 is opened, a moment (an overturning moment) may increase due to the center of gravity of the door 2 around a hinge shaft. A moment (a restoring moment) generated by a center of gravity of the cabinet 1 around the hinge shaft may offset the overturning moment, thereby preventing the cabinet 1 from overturning.

However, when a length of the cabinet 1 in a front and rear direction is smaller than a length of the cabinet 1 in a width direction, a value of the restoring moment that offsets the overturning moment may be reduced. In other words, because the length of the cabinet 1 in the front and rear direction is smaller than the length of the cabinet 1 in the width direction based on the drawing, when the door 2 is opened, there is a risk that the cabinet 1 may be overturned forward due to a weight of the door 2.

Therefore, the door 2 of the present disclosure may include a first door 21 capable of opening and closing a portion of the inlet 11 and a second door 22 capable of opening and closing the remaining portion of the inlet so as to limit a value of the overturning moment when the door is opened. The second door 22 may be located lower than the first door.

The first door 21 may include a first door frame 211 forming a frame of the door, a first door window 213 surrounded or supported by the first door frame 211 and disposed to face the portion of the inlet 11, and a first door hinge 215 disposed on the first door frame 211 so as to be rotatably coupled to the cabinet 1.

The first door frame 211 may be disposed to surround an outer surface of the first door window 211. Alternatively, the first door frame 211 may be coupled to a rear surface of the first door window 213 facing the inlet 11 such that only the first door window 213 may be exposed forwardly of the object treating apparatus 100.

The first door window 213 is disposed to face the inlet 11. The first door window 213 may be light-transmissive such that the inside of the first chamber 13 may be seen through the inlet 11 from the outside.

Alternatively, the first door window 213 may be formed as a display and display a space inside the first chamber 13 to the outside via a camera (not shown) disposed inside the first chamber 13. As such, the first door window 211 is not particularly limited as long as it is formed such that the space inside the first chamber 13 may be seen.

The first door hinge 215 pivotably connects the first door frame 211 to the cabinet 1. The first door hinge 215 may include a first upper door hinge 2151 coupled to the upper panel 121*a* disposed at an upper portion of the cabinet front surface 121, and a first lower door hinge 2153 coupled to a middle panel 1113 disposed between the upper panel 121*a* and the lower panel 121*b* of the cabinet front surface 121.

Similarly, the second door 22 may include a second door frame 231 forming a frame of the door, a second door window 223 surrounded or supported by the second door frame 231 and disposed to face the remaining portion of the inlet 11, and a second door hinge 235 disposed on the second door frame 221 so as to be rotatably coupled to the cabinet 1.

A description of the configuration of the second door 22 is omitted to an extent duplicated with that of the first door. The second door hinge 235 may include a second upper door hinge 2351 coupled to the middle panel 1113 and a second lower door hinge 2353 coupled to the lower panel 121*b* disposed at a lower portion of the cabinet front surface 121.

Figure 3:
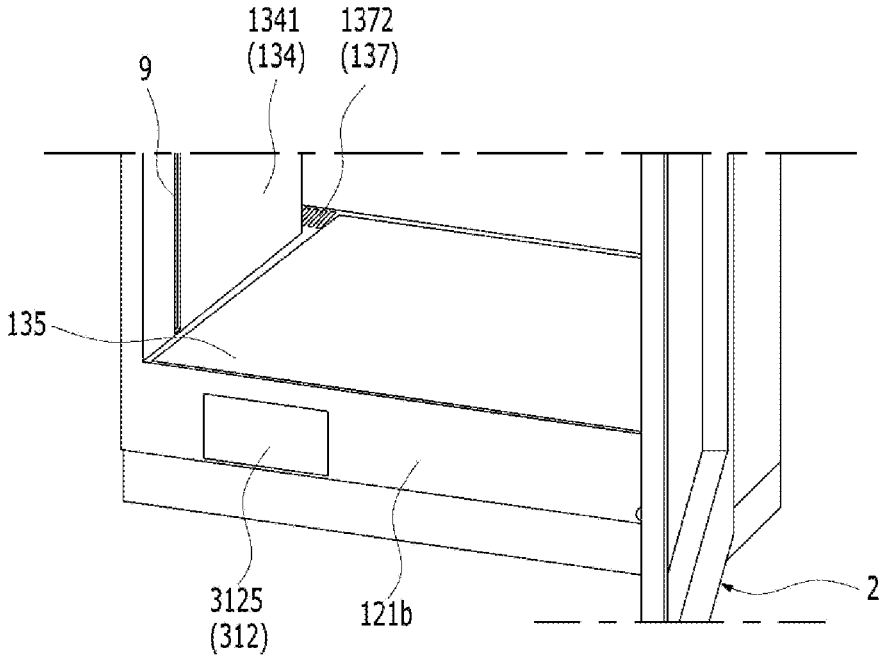
FIGS. 3(*a*) and (*b*) are enlarged views of a lower portion of an object treating apparatus.
Figure 3:
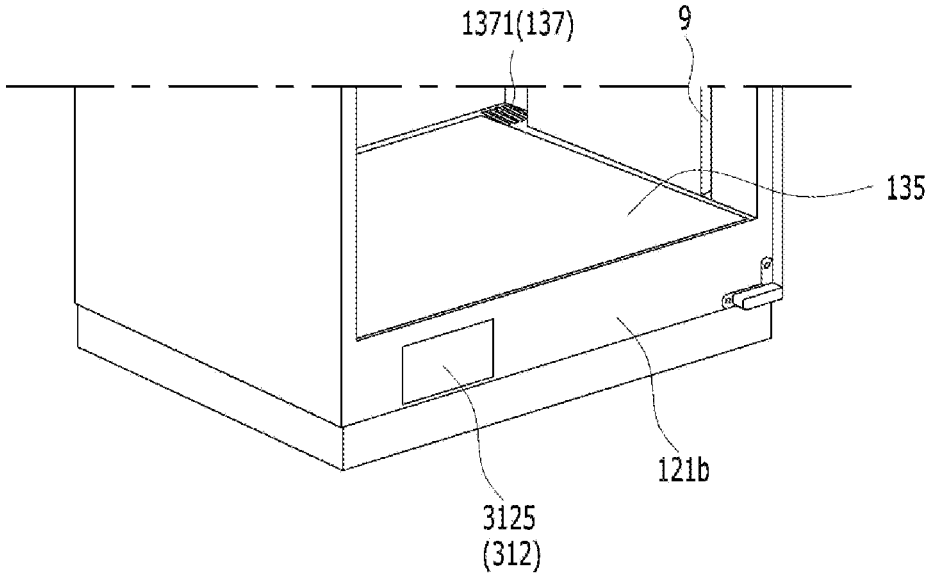
Figure 4:
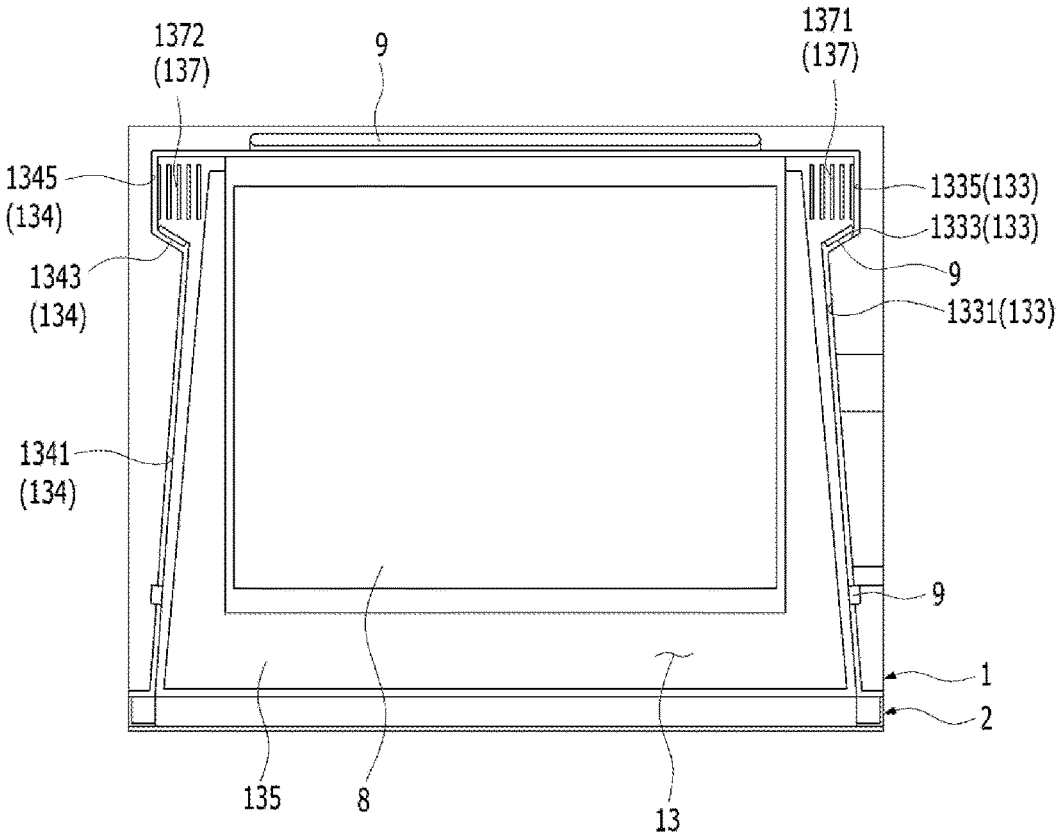
FIG. 4 is a plan view of an object treating apparatus.
Figure 5:
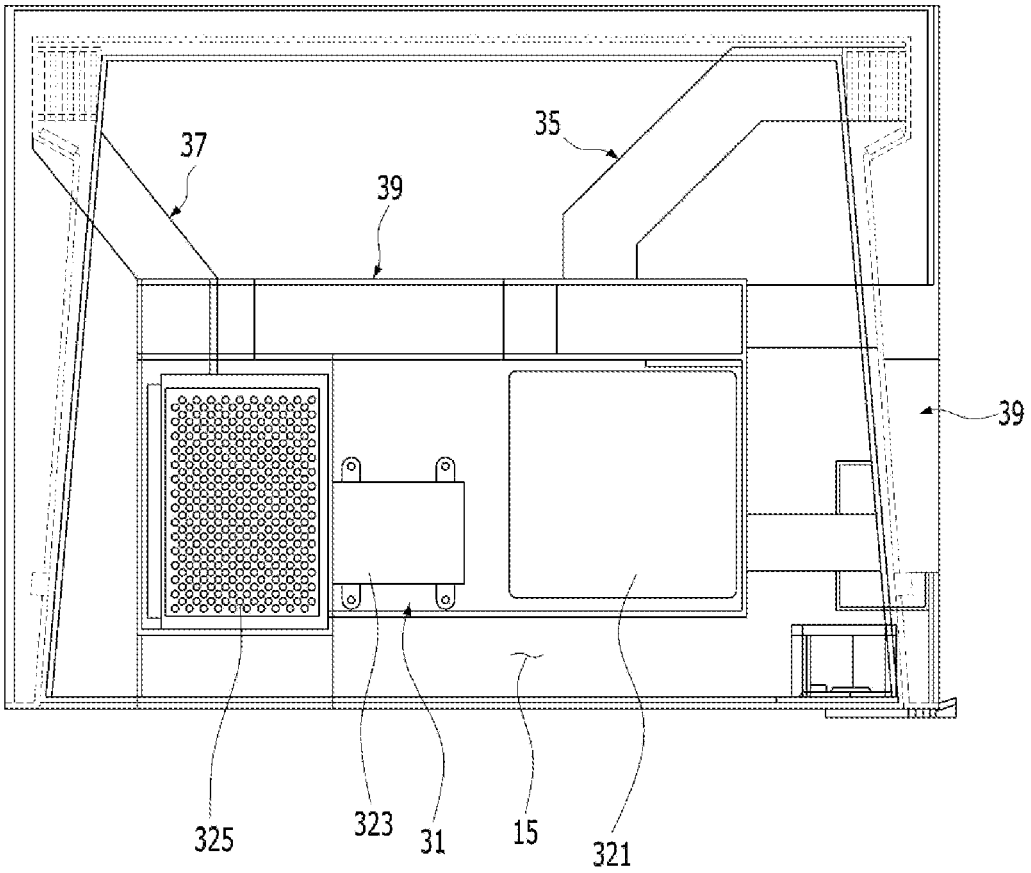
FIG. 5 is a plan projection view of an object treating apparatus.

Referring to FIGS. 3 to 5 together, the object treating apparatus of the present disclosure may include an air port 137 defined in the first chamber to allow air inside the first chamber to flow to the second chamber or allow air to flow from the second chamber into the first chamber.

A position where the air port 137 is disposed inside the first chamber 13 may vary depending on a position where the second chamber 15 is disposed. For example, when the second chamber 15 defines a space separated upwardly from the first chamber 13, the air port 137 may be defined in the top surface 136 of the first chamber 13. Based on the drawing, the air port 137 according to an example of the present disclosure is defined in the bottom surface 135 of the first chamber 13 and allows the first chamber 13 to be in communication with the circulating means 3 to be described later.

The air port 137 may include an air intake port 1371 defined to allow the air inside the first chamber 13 to flow into the circulating means 3 and an air discharge port 1372 defined to allow air inside the circulating means 3 to flow into the first chamber 13. That is, based on a flow of the air flowing in the circulating means 3, the air intake port 1371 is defined upstream of the circulating means and the air discharge port 1372 is defined downstream of the circulating means. The circulating means 3 may be a heating and/or cooling system.

As described above, the air inside the first chamber 13 may circulate inside the cabinet 1 while flowing along the circulating means 3 via the air intake port 1371 and the air discharge port 1372 defined in the first chamber 13.

The air intake port 1371 and the air discharge port 1372 may be defined closer to the first chamber rear surface 132 than to the inlet 11. The inlet 11 is in communication with the outside. When the air intake port 1371 and the air discharge port 1372 are defined close to the inlet 11, the circulation of the air inside the first chamber 13 is hindered when the door 2 is opened, which may cause difficulties in managing the air in the first chamber 13.

In addition, a shelf 8 to be described later may be disposed closer to the front surface, that is, the inlet 11, than to the rear surface 132 in the first chamber 13 such that the object to be mounted on the shelf may be better seen from the outside. In this regard, when the air intake port 1371 and the air discharge port 1372 are also defined closer to the inlet 11, the air circulation may be hindered by the shelf 8. As such, because the air intake port 1371 and the air discharge port 1372 are defined closer to the first chamber rear surface 132 than to the inlet 11, the air in the first chamber 13 may be effectively circulated.

In addition, because the first chamber 13 is a space for display as well as storage of the object, the air intake port 1371 and the air discharge port 1372 may be spaced apart from each other along a width direction of the first chamber to more efficiently circulate the first chamber 13 while limiting a size of the air port 137.

The first chamber 13 may have a length along the width direction greater than a length along a front and rear direction of the first chamber. In this regard, a flow path of the air inside the first chamber 13 may be further extended by maximally separating the air intake port 1371 and the air discharge port 1372 from each other. Accordingly, the air inside the first chamber 13 may be circulated more effectively and uniformly even with a limited passage area of the air port 137.

Figure 12:
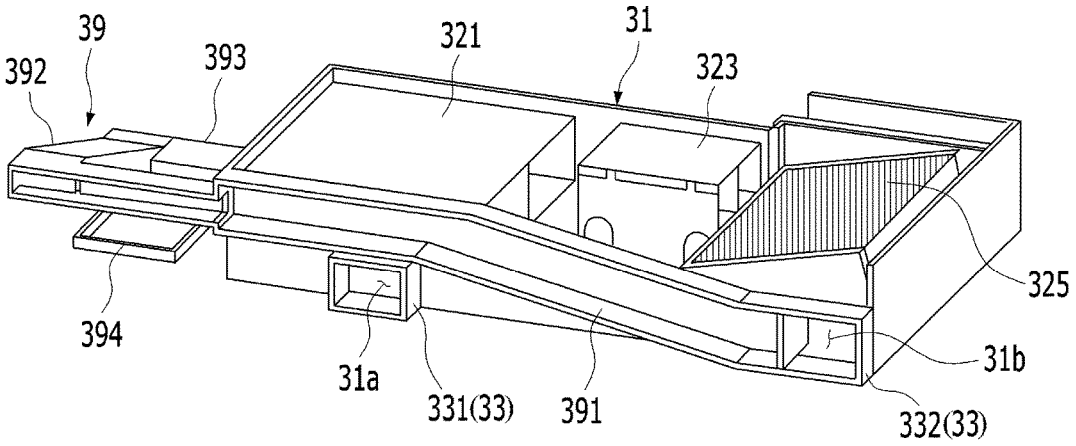
FIG. 12 is a cross-sectional perspective view taken along a line AA' in FIG. 11.

In addition, the air intake port 1371 may be defined closer to an inlet hole 31*a* (a first inlet hole) than an outlet hole 31*b* of a connection duct 31 in a direction parallel to the ground (see FIG. 12). In this regard, a distance in the direction parallel to the ground means a horizontal distance between the air intake port 1371 and the inlet hole 31*a* or the outlet hole 31*b*.

With such arrangement, a length of an air intake duct 35 for connecting the air intake port 1371 to the inlet hole 31*a* may be shortened and a duct structure may be simplified. When the length of the air intake duct 35 is reduced, a flow rate loss of air from the air intake port 1371 to the connection duct 31 may be minimized.

In addition, the air discharge port 1372 may be defined closer to the outlet hole 31*b* than the inlet hole 31*a* of the connection duct 31 in the direction parallel to the ground. With such arrangement, a length of an air discharge duct 37 for connecting the air discharge port 1372 to the outlet hole 31*b* may be shortened and a duct structure may be simplified. When the length of the air discharge duct 37 is reduced, a flow rate loss of air from the connection duct 31 to the air discharge port 1372 may be minimized.

The first chamber left side surface 133 may protrude toward the first chamber right side surface 134, so that the object treating apparatus may be inclined and stepped from the inlet 11 toward a rear portion of the first chamber 13. Specifically, the first chamber left side surface 133 may include a left inclined surface 1331 inclined such that the length in the width direction of the first chamber decreases rearwardly of the inlet 11, a left extended surface 1333 extending from a distal end of the left inclined surface 1331 such that the length in the width direction of the first chamber increases, and a left circulation surface 1335 extending from a distal end of the left extended surface 1333 toward the first chamber rear surface 132.

Similarly, the first chamber right side surface 134 may protrude toward the first chamber left side surface 133, so that the object treating apparatus may be inclined and stepped from the inlet 11 toward the rear portion of the first chamber 13. Specifically, the first chamber right side surface 134 may include a right inclined surface 1341 inclined such that the length in the width direction of the first chamber decreases in a direction from the inlet 11 toward the first chamber rear surface 132, a right extended surface 1343 extending from a distal end of the right inclined surface 1341 such that the length in the width direction of the first chamber increases, and a right circulation surface 1345 extending from a distal end of the right extended surface 1343 toward the first chamber rear surface 132.

Both side surfaces 133 and 134 of the first chamber may be inclined and stepped, narrowing in width from the inlet 11 to the rear portion of the first chamber 13 by the inclined surfaces 1331 and 1341 and then widening again by the extended surfaces 1333 and 1343.

In the structure described above, the both side surfaces 133 and 134 may be inclined and stepped by the inclined surfaces 1331 and 1341 and the extended surfaces 1333 and 1343. In this regard, the air port may be defined in a space between the left circulation surface 1335 and the right circulation surface 1345. In order to minimize the inhibition of the air circulation caused by the opening and closing of the inlet 11 without being obstructed by the shelf 8, the air port may be defined between the left circulation surface 1335 and the right circulation surface 1345 disposed at the rear of a stepped structure (the inclined surfaces and the extended surfaces).

One of the air intake port 1371 and the air discharge port 1372 may be defined in a stepped space defined by the left extended surface 1333 and the left circulation surface 1335, and the other may be defined in a stepped space defined by the right extended surface 1343 and the right circulation surface 1345. Because the stepped space in which at least a portion of the air port 137 is not viewable from the inlet 11 is defined, a path through which air flows in or out of the first chamber may be defined. Accordingly, the object treating apparatus 100 may effectively circulate the air inside the first chamber 13.

Further, in this structure, the first chamber may be formed in a trapezoidal shape in which the space between the left inclined surface 1331 and the right inclined surface 1341 gradually widens in a forward direction. Because the width of the first chamber 13 varies by the inclined surfaces 1331 and 1341, the air may more effectively flow from the space between the left circulation surface 1335 and the right circulation surface 1345 where the air port 137 is defined toward the space between the left inclined surface 1331 and the right inclined surface 1341.

As the width of the first chamber 13 gradually increases from the rear portion of the first chamber 132 toward the inlet 11, a pressure difference may be formed between the rear portion and a front portion of the first chamber 132, and as a result, the air circulation in the front and rear direction may be smoothly performed inside the first chamber.

The shelf 8 may be mounted on a shelf coupling portion 1325 disposed at the rear portion of the first chamber. Alternatively, the shelf 8 may be mounted by being coupled to at least one of the both side surfaces of the first chamber, more specifically, the left inclined surface 1331 and the right inclined surface 1341. A lighting 9 may be disposed on the rear surface 132 and the side surfaces 133 and 134 of the first chamber.

Figure 6:
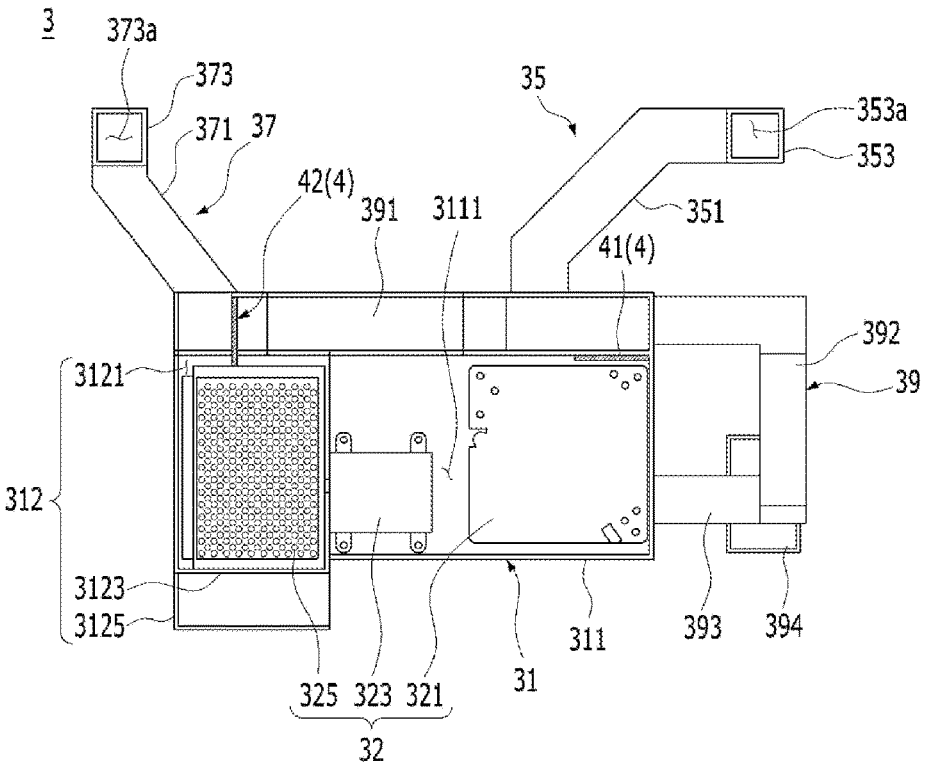
FIG. 6 is a plan view of circulating means.
Figure 7:
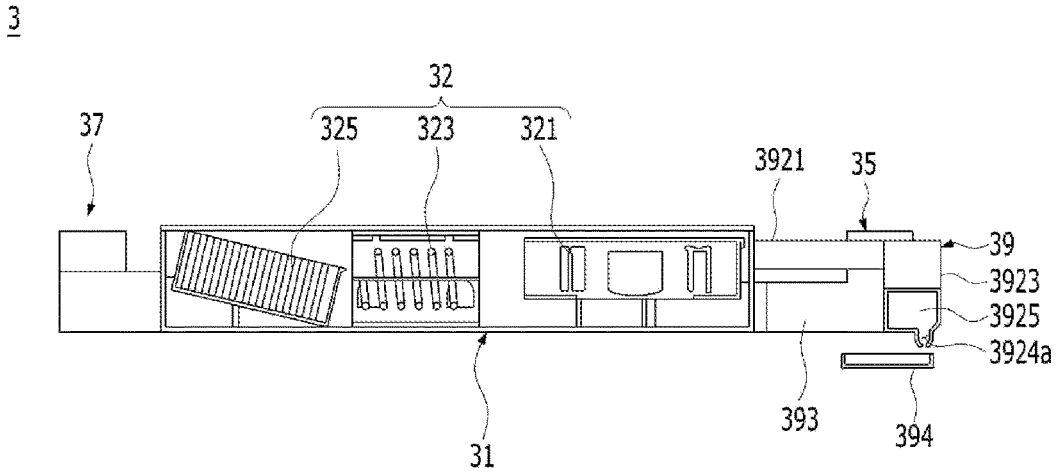
FIG. 7 is a front view of circulating means.
Figure 8:
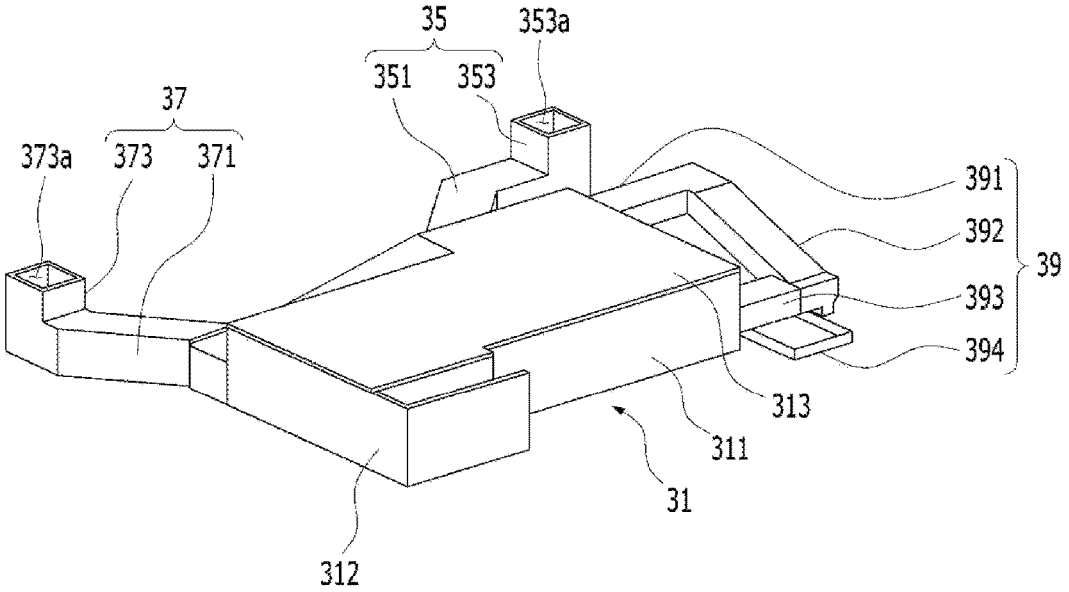
FIG. 8 is a perspective view of circulating means.
Figure 9:
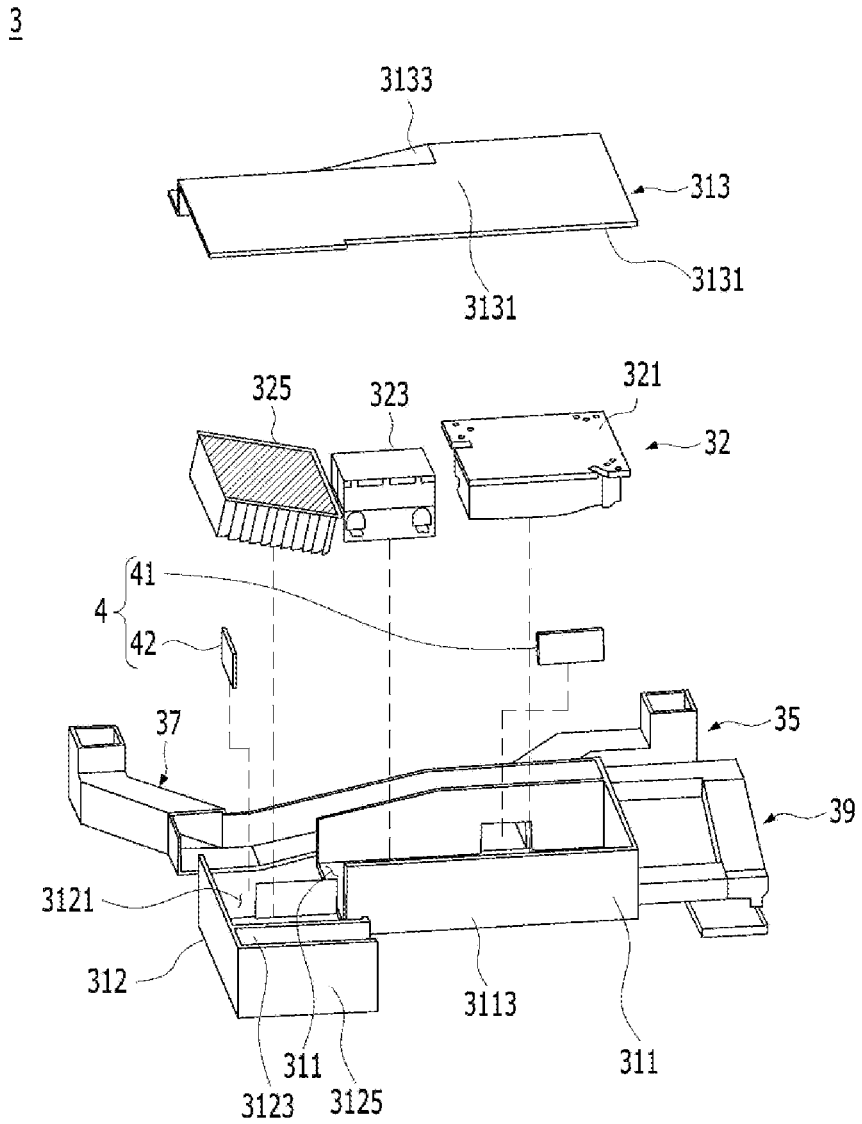
FIG. 9 is an exploded perspective view of circulating means.
Figure 10:
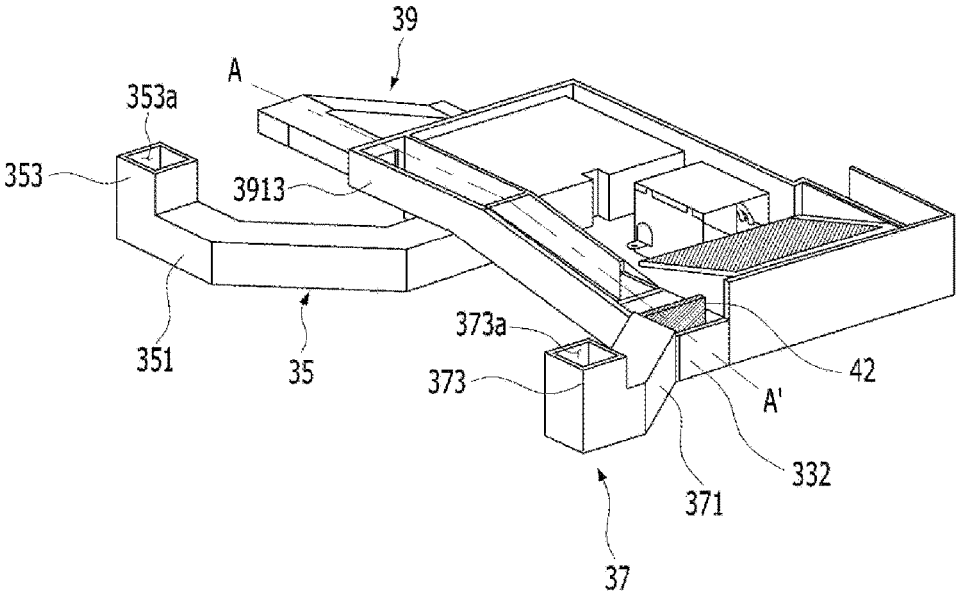
FIG. 10 is a perspective view of circulating means viewed from another direction.
Figure 11:
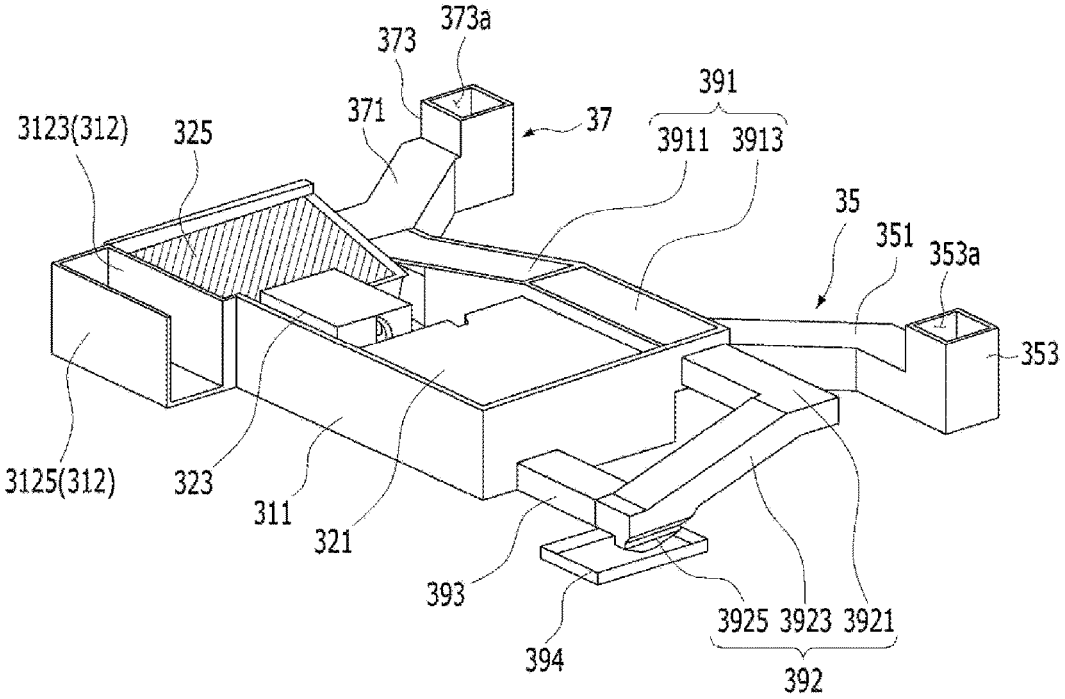
FIG. 11 is a perspective view of circulating means viewed from still another direction.
Figure 13:
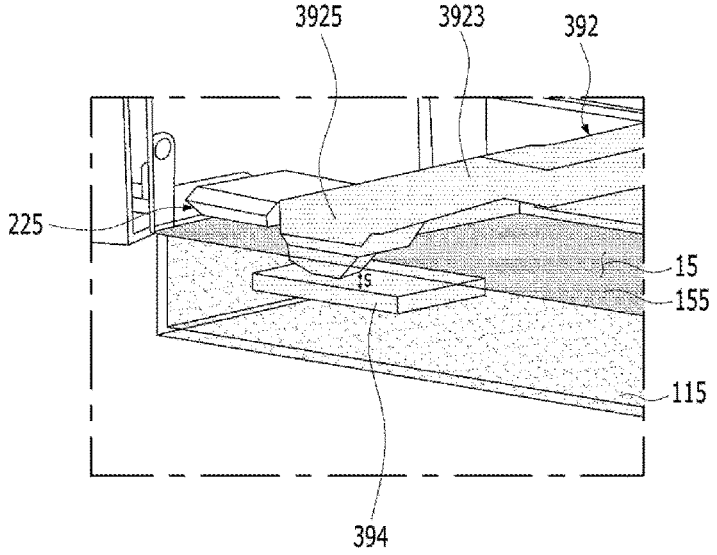
FIG. 13 is an enlarged projection view of a regeneration flow channel.

FIG. 6 is a plan view of circulating means, FIG. 7 is a front view of circulating means, FIG. 8 is a perspective view of circulating means, FIG. 9 is an exploded perspective view of circulating means, FIG. 10 is a perspective view of circulating means viewed from another direction, FIG. 11 is a perspective view of circulating means viewed from still another direction, FIG. 12 is a cross-sectional perspective view taken along a line AA' in FIG. 10, and FIG. 13 is an enlarged projection view of a regeneration flow channel.

The circulating means will be described with reference to FIGS. 6 to 13. The circulating means 3 is disposed inside the second chamber 15, so that the air inside the first chamber 13 circulates. The air introduced from the first chamber 13 to the circulating means may be treated, such as dehumidified or filtered, while flowing along the circulating means 3, and then introduced into the first chamber 13 again.

The above circulating means 3 may include the connection duct 31 through which the circulating air passes, air conditioning means 32 disposed in the connection duct 31 to circulate the air and treat the air, a suction duct 35 disposed such that the air inside the first chamber 13 flows into the connection duct 31, and a discharge duct 37 disposed to discharge the air inside the connection duct 31 to the first chamber 13. The air conditioning means may correspond to an air handler or air handler unit.

The connection duct 31 may include a hub or connection body 311 on which the air conditioner 32 is seated. In addition, the connection duct 31 may further include a replacement body 312 disposed to be movable from the hub body 311 so as to be extended from the cabinet. Details of the replacement body 312 will be described later.

In addition, the connection duct 31 may include a hub cover 313 for covering the hub body 311 and the replacement body 312. The hub cover 313 may include a body cover 3131 for covering the hub body 311 or both the hub body and the replacement body, and a regeneration cover 3133 for covering at least a portion of the regeneration duct to be described later (see FIG. 9).

The air conditioning means 32 may be disposed in an internal space of the connection duct 31, and the air may flow along the internal space of the connection duct 31. The connection duct 31 may be broadly defined as a housing to include the air conditioning means or air handler.

The air conditioning means 32 may include a blowing fan 321 with an impeller driven by a motor for circulating the air, heater 323 for heating the flowing air, and air filter 325 for treating the flowing air. The term "blowing fan" is intended to cover fan, blowers and/or compressor depending on the design for volume flow rate.

The blowing fan may be disposed inside the connection duct 31 to form the pressure difference such that the air circulates. The air inside the first chamber may be introduced into the circulating means and the air inside the circulating means 3 may be discharged into the first chamber 13 by the blowing fan 321.

The heater 323 may be disposed in the connection duct and may heat the air passing through the connection duct 31. The heater or heat pump is disposed to increase a temperature inside the first chamber 13 or to regenerate the air filter 325 to be described later.

The air filter 325 may be disposed inside the connection duct and may treat the flowing air. The air filter 325 may contain a material that adsorbs and removes moisture or contaminants in the air, such as a porous material, for example, zeolite or activated carbon. The air filter 325 may be regenerated as the moisture collected in the air filer 325 evaporates as the air heated by the heater 323 is introduced. The regeneration of the air filter 325 will be described later.

However, the air filter 325 is not necessarily limited thereto, and is not particularly limited to the above-mentioned materials as long as it is capable of treating the air inside the first chamber 13.

In addition, in the present document, the "air treatment" should be understood as a comprehensive concept that includes dehumidification to remove the moisture from the air, deodorization to remove odor particles in the air, and purification or filtration to filter or adsorb and remove pollutant particles from the air. That is, it should be understood that the air is treated when at least one function of the dehumidification, the deodorization the filtration, and the purification is performed.

In other words, the present disclosure is designed to display and store the object inside the first chamber 13 under optimal environmental conditions. Unlike a heat pump that includes a separate refrigerant circulation flow channel, a volume of the second chamber (the machine room) 15 may be reduced.

Based on the air flowing inside the connection duct 31, in the air conditioning means 32, the blowing fan 321 may be disposed upstream of the heater 323 and the heater 323 may be disposed upstream of the air filter 325.

In addition, the heater 323 may be disposed closer to the air filter 325 than the blowing fan. This is to supply heat to the air filter 325 without heat loss from the heater.

As will be described later, the connection duct 31 may include a first flow channel through which the air in the first chamber circulates and a second flow channel through which the air inside the connection duct 31 circulates along a regeneration duct 39. The second flow channel is disposed to circulate the air between the connection duct and the regeneration duct during the regeneration process of the air filter 325.

That is, according to an example of the present disclosure, in the present disclosure, the air may be managed while independently circulating through the first flow channel for managing the object inside the first chamber and the second flow channel for the regeneration process of the air filter 325.

In addition, the connection duct 31 may include the inlet hole 31*a* through which the air from the first chamber is introduced, the outlet hole 31*b* through which the air inside the connection duct 31 is discharged, and a regeneration hole 31*c* (a second inlet hole) through which the air is introduced into the connection duct 31 via the regeneration duct to be described later.

The inlet hole 31*a* may be defined closer to the blowing fan 321 than the air filter 325. The inlet hole 31*a* may be defined to face the blowing fan 321. When the inlet hole 31*a* faces the blowing fan 321, the air inside the first chamber 13 may be introduced into the inlet hole 31*a* without the flow rate loss caused by bending of the flow channel.

Similarly, the outlet hole 31*b* may be defined closer to the air filter 325 than the blowing fan 321, and may be defined to face the air filter 325 to minimize a loss of the flow channel.

The air intake duct 35 may allow the first chamber 13 and the inlet hole 31*a* to be in communication with each other. The air intake duct 35 may include a suction duct body 351 in communication with the connection duct 31 via the inlet hole 31*a* and a suction duct guide 353 extending from the suction duct body 351 to the first chamber 13 so as to be connected to the air intake port.

As shown in the drawing, when the second chamber 15 is disposed beneath the first chamber 13, the suction duct guide 353 may extend upward from a distal end of the suction duct body 351 to guide the air introduced via the air intake port 1371 to the suction duct body 351. The suction duct body 351 may provide a flow channel through which the introduced air flows to the inlet hole 31*a*.

The discharge duct may allow the outlet hole 31*b* and the first chamber to be in communication with each other. The discharge duct 37 may provide a space through which the air discharged from the connection duct 31 via the outlet hole 31*b* is introduced into the first chamber 13. The discharge duct 37 may include a discharge duct body 371 providing a space in which the air discharged from the connection duct 31 via the outlet hole 31*b* flows, and a discharge duct guide 373 extending from the discharge duct body 371 toward the first chamber and connected to the air discharge port 1372.

As shown in the drawing, when the second chamber 15 is disposed beneath the first chamber 13, the discharge duct guide 373 may extend upward toward the air discharge port 1372 from a distal end of the discharge duct body 371.

The circulating means 3 may further include the regeneration or recirculation duct 39 constructed such that the air discharged from the connection duct 31 to the outside of the connection duct 31 is introduced into the connection duct 31 again. As appreciated, the regeneration/recirculation duct 39 may be referred to as a return duct.

The regeneration duct 39 is disposed inside the second chamber 15 and has one end connected to the outlet hole 31*b* and the other end in communication with the regeneration hole 31*c*, thereby forming a closed circulation flow channel through which the air discharged from the connection duct 31 via the outlet hole 31*b* is introduced back into the regeneration hole.

As will be described later, the regeneration duct is disposed to regenerate the air filter in the regeneration process.

The regeneration duct 39 may include a first regeneration (return) duct body 391 in communication with the outlet hole 31*b* and including an inclined section inclined upward or downward, a second regeneration (return) duct body 392 extending from the first regeneration duct body 391 and including an inclined section inclined downward or upward, and a third regeneration duct body 393 extending from the second regeneration (return) duct body 392 and in communication with the regeneration hole 31*c*.

The first regeneration duct body 391 may include a first inclined portion 3911 including the inclined section inclined upward or downward as one end thereof is in communication with the outlet hole 31*b*, and a flat portion extending from a point where the inclined section of the first inclined portion 3911 ends toward a side surface of the second chamber.

The first inclined portion 3911 may be inclined such that at least a portion of the regeneration duct 39 is disposed upwardly or downwardly of the suction duct or the discharge duct.

Based on the drawing, the first inclined portion 3911 is inclined upward and the flat portion 3913 extends from the first inclined portion 3911 toward the side surface of the second chamber. In this regard, at least a portion of the first regeneration duct body 391 is disposed upwardly of the suction duct body. That is, the first regeneration duct body 391 and the suction duct body 351 may at least partially overlap each other in a vertical direction.

That is, with such a three-dimensional structure in which the first regeneration duct body 391 and the suction duct body 351 at least partially overlap each other in the vertical direction, space efficiency inside the second chamber 15 may be maximized. Therefore, a size of a space defined by a duct flow channel inside the second chamber 15 may be further reduced, and a size of the space of the first chamber 13 may be further expanded.

The second regeneration duct body 392 includes an extended portion 3921 extending from the flat portion 3913 of the first regeneration duct body 391 toward the side surface of the second chamber 15 and in contact with the side surface of the second chamber 15, a second inclined portion 3923 including the inclined section extending from the extended portion and inclined in a direction opposite to that of the inclined section of the first inclined portion, and a drainage portion 3925 having a drainage hole 3924*a* such that condensed water condensed in the second inclined part 3923 is discharged to a tray 394 to be described later.

The extended portion 3921 may extend further than the connection duct 31 toward the side surface of the second chamber 15 and may be in contact with the side surface of the second chamber 15.

The second inclined portion 3923 is bent toward the regeneration hole 31*c* from a distal end of the extended portion 3921 and is inclined opposite to the first inclined portion. A height of the second inclined portion 3923 is the same as that of the first inclined portion 3911, so that the outlet hole 31*b* and the regeneration hole 31*c* may be located at the same vertical level. When the outlet hole 31*b* and the regeneration hole 31*c* are located at the same vertical level, a friction or a flow rate loss that may occur when the air flows inside the connection duct may be minimized.

In addition, at least a portion of the second inclined portion 3923 is continuously in contact with the side surface of the second chamber. As will be described later, when the air heated via the heater circulates along the regeneration duct 39, the air may be condensed by the second regeneration duct body including the second inclined portion 3923. The condensed water discharged from the air condensed while passing through the second inclined portion may flow along the inclination to the third regeneration duct body.

Therefore, the first inclined portion 3911 is inclined upward so as to be disposed upwardly of the suction duct and the second inclined portion 3923 is inclined downward so as to guide the condensed water to the third regeneration duct body.

The side surface of the second chamber 15 may be defined as an inner surface of the cabinet inside the second chamber 15. In the drawing, the second regeneration duct body 392 is illustrated as extending to the left side surface of the second chamber 15, but is not necessarily limited thereto, and is able to extend to the right side surface. In addition, herein, the side surface of the second chamber means one surface inside the second chamber 15, and should be understood to include the front and rear surfaces of the second chamber 15.

The third regeneration duct body 393 is bent and extends from a distal end of the second regeneration duct body to the regeneration or return hole 31*c*. The third regeneration duct body 393 may include a drainage hole defined by extending through a lower portion of the third regeneration duct body 393. The condensed water condensed and produced in the second regeneration duct body 392 may be drained downward via a drainage hole 3924*a* of the third regeneration duct body 393.

The regeneration duct 39 may include the tray 394 disposed below the drainage hole 3924*a* to collect the condensed water drained from the third regeneration duct body 393. The condensed water collected in the tray 394 may evaporate naturally.

In addition, the tray 394 may be constructed to be extended to the outside via a tray outlet (not shown) defined in the cabinet 1, so that the user may directly dispose of the water collected in the tray. Therefore, generation of mold or odor caused by the remaining condensed water may be minimized and the object may be managed more hygienically.

Figure 15:
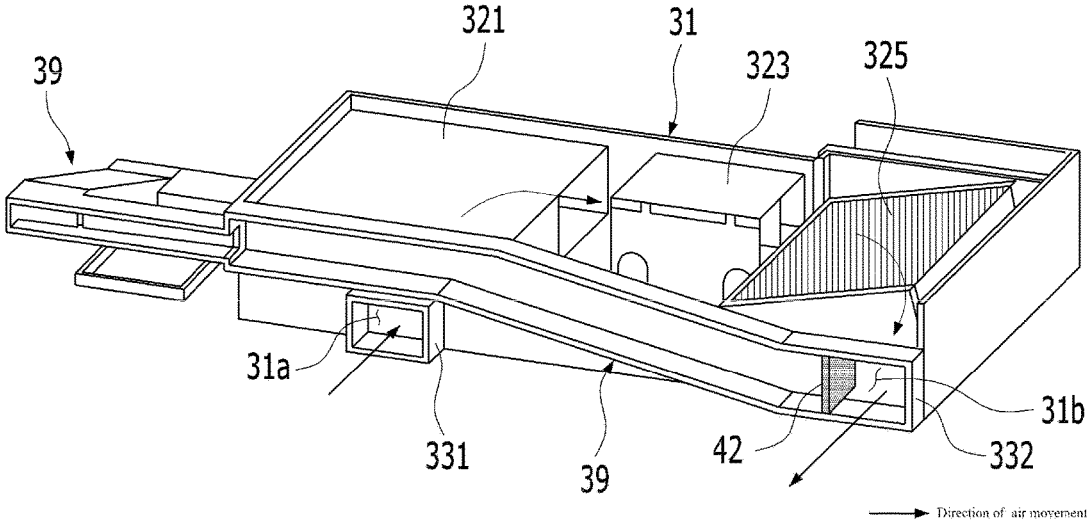
FIG. 15(*a*) is a cross-sectional perspective view of (*a*) in FIG. 14.
Figure 15:
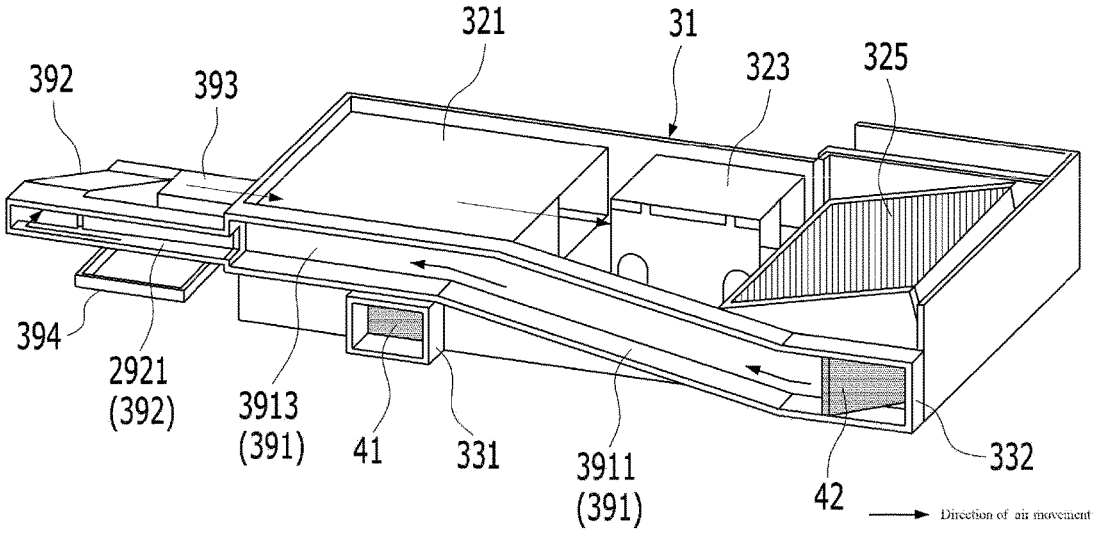

Referring to FIG. 13, the tray may be located downwardly of the connection duct 31 for smooth drainage of the condensed water. For example, the connection duct 31 may be seated on the bottom surface 155 of the second chamber 15. The tray may be disposed downwardly by a predetermined distance S of the bottom surface 155 of the second chamber, and may be located between the bottom surface of the second chamber 15 and the bottom surface 115 of the cabinet 1. As shown in FIG. 15, the tray may be located downwardly of the connection duct 31 for the smooth drainage of the condensed water.

For example, the connection duct 31 may be seated on the bottom surface 155 of the second chamber 15. The tray may be disposed downward by the predetermined distance S of the bottom surface 155 of the second chamber, and may be located between the bottom surface of the second chamber 15 and the bottom surface 115 of the cabinet 1.

With such arrangement, not only the condensed water may be drained smoothly, but also a space where the condensed water is drained (a space between the bottom surface 155 of the second chamber and the bottom surface 115 of the cabinet) and a space where the air circulate (the second chamber 15) may be separated from each other, so that the second chamber may be managed more hygienically.

The circulating means 3 includes a hub 33 for allowing the suction duct, the discharge duct, and the regeneration return duct to be in communication with the inlet hole or the outlet hole. The hub 33 may include a first hub 331 for allowing the suction duct and the inlet hole 31*a* to be in communication with each other and a second hub 332 for allowing the outlet hole 31*b*, the discharge duct 37, and the regeneration duct (the first regeneration duct body) to be in communication with each other.

The first hub 331 may be disposed upstream of the inlet hole 31*a* and downstream of the suction duct 35 based on the air flow. The first hub 331 may define a space in which the suction duct 35 and the inlet hole (or the connection duct) are in communication with each other to provide a space in which a first switching portion 41 to be described later is disposed. The air introduced via the suction duct may flow into the inlet hole 31*a* via the first hub 331.

The second hub 332 may be disposed downstream of the outlet hole 31*b* and may be disposed upstream of the discharge duct and the regeneration duct based on the air flow. The second hub 332 may define the space in which the discharge duct, the regeneration duct, and the outlet hole (or the connection duct) are in communication with each other to form a three-way flow channel. That is, the air discharged from the outlet hole 31*b* may be diverged from the second hub 332 and be in communication with the discharge duct and the regeneration duct.

The circulating means 3 may further include a flow channel switching portion or a flow valve 4 disposed in the hub 331 to allow one of several ducts to be in communication with the connection duct. The flow channel switching portion 4 may include the first switching portion 41 disposed in the first hub 331 to allow the suction duct and the inlet hole 31*a* to be in communication with each other or to be blocked from each other.

In addition, the flow channel switching portion 4 may further include a second switching portion 42 disposed in the second hub 332 to selectively allow one of the discharge duct and the regeneration duct and the outlet hole to be in communication with each other. The second switching portion may block one flow channel in the second hub based on an arranged angle thereof.

In the flow channel switching portion 4, an arrangement of the first switching portion and the second switching portion may be varied under control of a controller (not shown) to selectively switch one of a first flow channel and a second flow channel to be described later. Operation of the flow channel switching portion 4 and a structure in which the flow channel is switched accordingly will be described later. As appreciated, the flow channel switching portion may be a diverter or a damper or flow valve.

Figure 14:
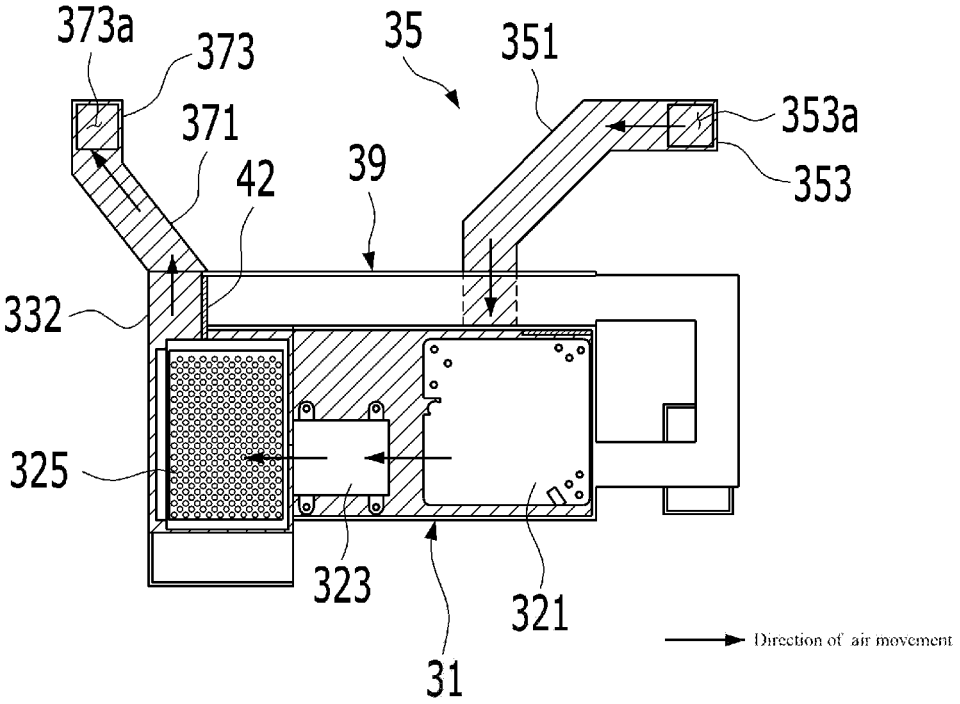
FIG. 14(*a*) is a view showing a flow of air in circulating means via a first flow channel.
Figure 14:
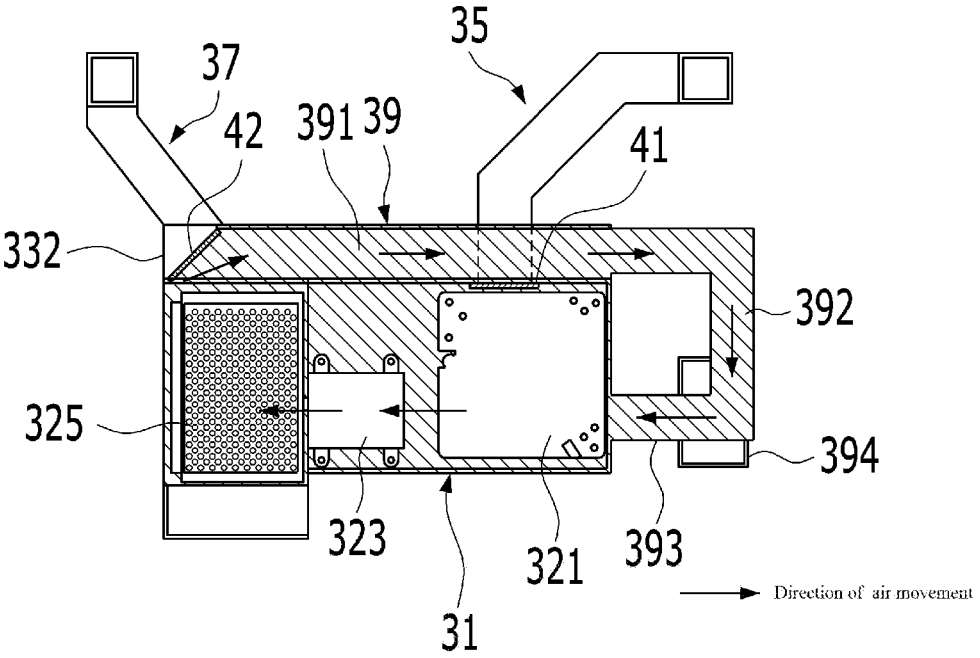
Figure 16:
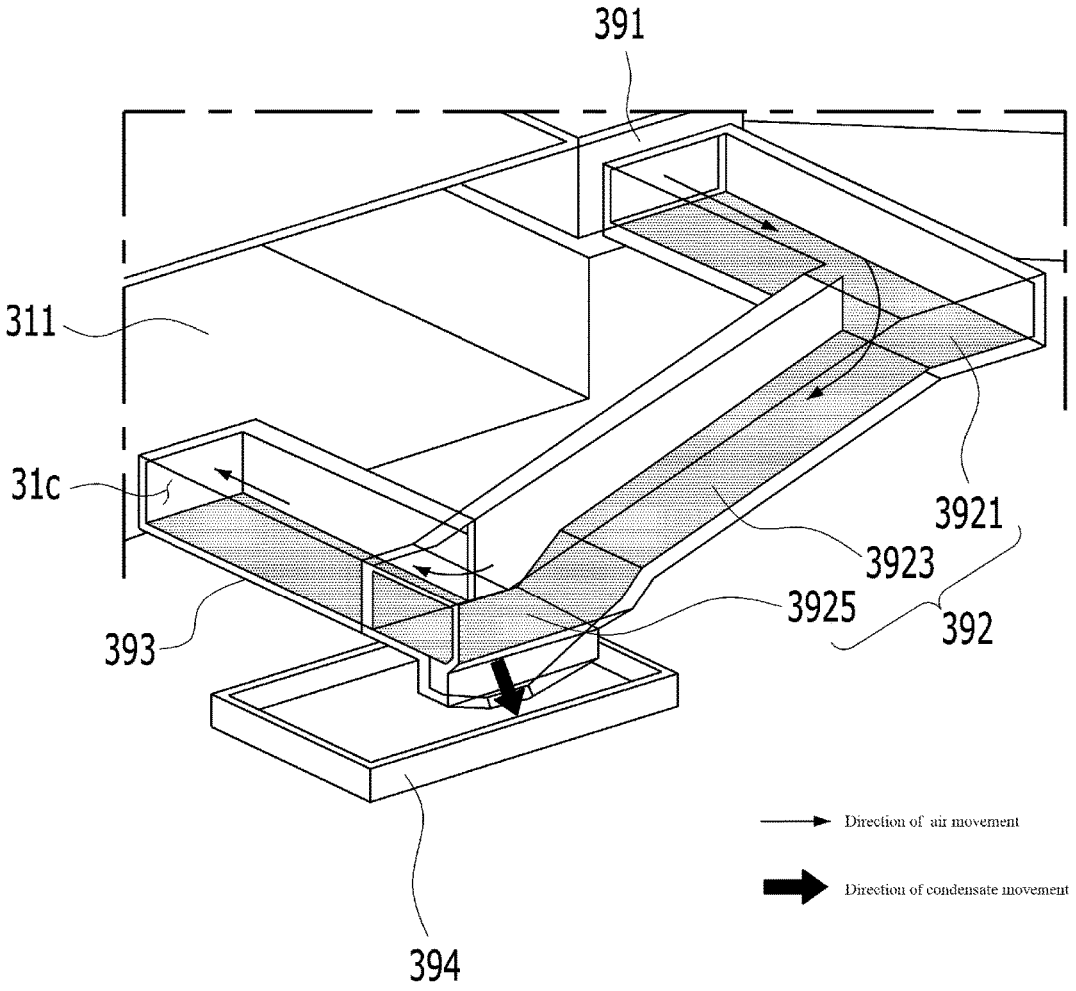
FIG. 16 is a view showing a flow of a fluid flowing along a regeneration flow channel.

(*a*) in FIG. 14 is a view showing a flow of air in circulating means via a first flow channel, (*b*) in FIG. 14 is a view showing a flow of air in circulating means via a second flow channel, (*a*) in FIG. 15 is a cross-sectional perspective view of (*a*) in FIG. 14, (*b*) in FIG. 15 is a cross-sectional perspective view of (*b*) in FIG. 14, FIG. 16 is a view showing a flow of a fluid flowing along a regeneration flow channel.

Referring to FIGS. 13 to 15 together, the circulating means 3 may further include the first flow channel including the connection duct 31 and constructed to circulate the air in the first chamber 13 and the second flow channel including the connection duct 31 and constructed to circulate the air in the connection duct 31 along the regeneration flow channel 39.

The first flow channel may be defined as a path in which the air of the first chamber is introduced via the air intake port 1371, flows along the suction duct 35, the connection duct 31, and the discharge duct 37, and then flows again to the first chamber 13 via the air discharge port 1372. In addition, the first flow channel may include a duct structure in which the air of the first chamber 13 circulates in the second chamber 15, that is, the suction duct, the connection duct, and the discharge duct.

As shown in the drawing, the flow channel switching portion may be controlled such that the first switching portion is aligned to allow the suction duct and the inlet hole to be in communication with each other and the second switching portion is aligned such that the outlet hole and the discharge duct are in communication with each other.

As such, a state in which the first switching portion 41 and the second switching portion are arranged such that the flow channel switching portion 4 allows only circulation of the air via the first flow channel is defined as a circulation mode.

The second flow channel may be defined as a path through which the air discharged from the connection duct 31 via the outlet hole 31*b* flows along the regeneration duct and then circulates back to the connection duct via the regeneration hole 31*c*. As shown in the drawing, the flow channel switching portion 4 may be controlled such that the first switching portion is aligned such that the suction duct and the inlet hole are blocked from each other and the second switching portion is aligned such that the outlet hole and the regeneration duct are in communication with each other.

As such, a state in which the first switching portion 41 and the second switching portion 42 are arranged or aligned such that the flow channel switching portion 4 allows only circulation of the air via the second flow channel for the regeneration process of the air filter 325 is defined as a regeneration mode.

The controller may control the air conditioning means 32 to operate the heater while controlling the flow channel switching portion 4 in the regeneration mode. The controller may evaporate the moisture adsorbed to the air filter 325 or remove the contaminants by allowing the heated air to pass through the air filter 325 while the heater is operating. The air that has passed through the air filter may circulate along the regeneration flow channel.

FIG. 16 is a view showing a flow of a fluid flowing along a regeneration flow channel.

Referring to FIG. 16, the air that has been heated by the heater and has passed through the air filter 325 may flow into the first regeneration duct body 391 and circulate along the second regeneration duct body 392. The air flowing to the second regeneration duct body 392 may come into contact with the side surface of the second chamber along the extended portion 3921. In addition, the air may be condensed by exchanging heat with the side surface of the second chamber while flowing downward along the second inclined portion 3923.

The condensed water generated as the air flows along the second inclined portion 3923 may be drained downwardly of the second chamber via the drainage hole of the drainage portion 3925 and collected in the tray 394.

In addition, the air from which the condensed water is removed while flowing along the second inclined portion 3923 may flow along the third regeneration duct body 393 and be introduced into the connection duct 31 via the regeneration hole 31*c*.

As such, the present disclosure may extend a lifespan of the air filter 325 via the regeneration mode for operating the second flow channel that regenerates the air filter 325.

When the air filter 325 is made of the porous material, a fouling phenomenon in which pores are clogged by foreign substances such as dust adsorbed on the air filter may occur. When the fouling occurs, not only a filtering performance but also the life span of the air filter may decrease. Despite of being in the regeneration mode, it may be difficult to directly remove the foreign substances adsorbed in the pores of the porous material. Therefore, there is a need for a structure capable of replacing the air filter outside the cabinet without disassembling the circulating means.

Figure 17:
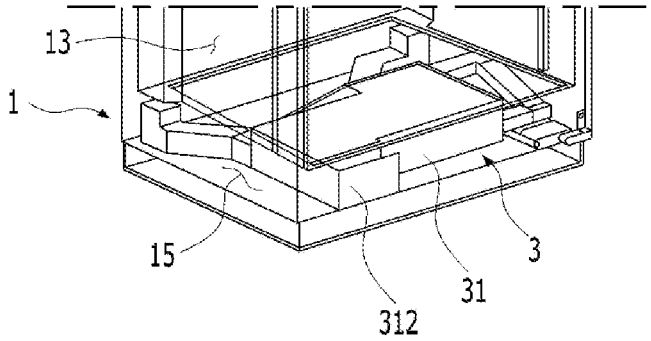
FIGS. 17(*a*) and (*b*) are projection views showing that a replacement body is extended.
Figure 17:
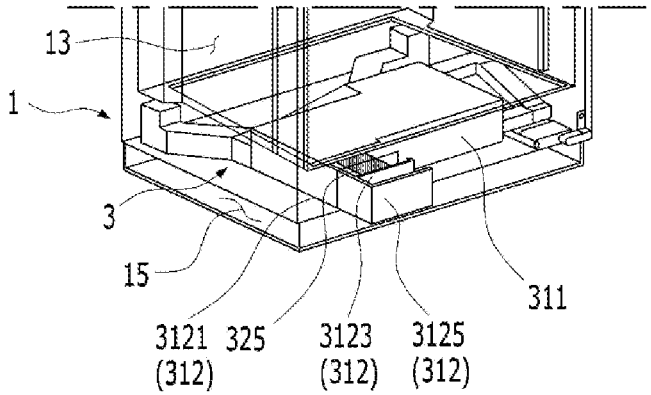

(*a*) and (*b*) in FIG. 17 are projection views showing that the replacement body is extended.

Referring to FIG. 17, in the present disclosure, a replacement hole (not shown) that is defined through an outer circumferential surface of the cabinet 1 and allows the air filter to be extended may be defined.

In addition, the connection duct 31 may include a connection body 31 equipped with a seating surface 3111 on which at least one of the components of the air conditioner 32 may be seated, and the replacement body 312 equipped with a detachment surface 3121 providing a space in which the air filter 325 is detachably seated. In this regard, the air filter may be detachably coupled to the detachment surface 3121 of the replacement body 312.

The replacement body 312 may include the detachment surface 3121 on which the air filter is detachably seated, a replacement housing 3123 forming a portion of an outer appearance of the connection duct 31, and a replacement panel 3125 extending from the replacement housing 3123 and exposed to the outside of the cabinet 1 via the replacement hole.

The replacement housing 3123 may extend from an outer circumferential surface of the connection body 31 such that the air inside the connection duct 31 does not leak out when the replacement body 312 is accommodated in the connection duct 31.

The replacement panel 3125 may have a shape corresponding to the replacement hole so as to fill the replacement hole when the replacement body 312 is accommodated in the connection duct 31. Because the second chamber 15 is located beneath the first chamber based on the drawing, the replacement hole may also be defined in the lower panel 121*b* of the cabinet 1. In this regard, the replacement panel 3125 may be constructed to minimize a step difference with the lower panel 121*b*, and may be exposed from the replacement hole to constitute a portion of the lower panel 121*b*.

The user may pull the replacement panel forwardly of the cabinet, so that the air filter 325 mounted on the detachment surface 3121 may be withdrawn so as to be exposed to the outside of the cabinet 1 via the replacement hole. The user may remove the exposed air filter 325 from the detachment surface 3121 and mount a new air filter 325 on the detachment surface 3121. Then, the user pushes the replacement body 312 toward the rear surface of the cabinet 1 such that the replacement panel 3125 is flush with the lower panel 121*b*, so that the air filter 325 may be disposed inside the connection duct 31. With such series of processes, the user may easily replace the air filter 325 without disassembling the circulating means 3.

The structure of the object treating apparatus described above is an example of the present disclosure, and is able to be modified and implemented in various forms, so that the scope of rights is not limited to the above-described embodiment. Therefore, when the modified embodiment includes components of the claims of the present disclosure, it should be regarded as belonging to the scope of rights of the present disclosure.

The present disclosure is to provide an object treating apparatus equipped with a first chamber for displaying an object outside while storing the object under environmental conditions suitable for the object, and a second chamber in which air is treated separately from the first chamber.

In addition, the present disclosure is to provide an object treating apparatus capable of reducing a volume of a second chamber as a porous material that performs one or more functions of air dehumidification and filtration is disposed inside a second chamber separated from a first chamber, compared to a case in which a heat pump is disposed in the second chamber.

In addition, the present disclosure is to provide an object treating apparatus separately including a flow channel for regenerating a saturated and adsorbed porous material via a closed circulation flow channel disposed inside a second chamber, and a flow channel circulating in a first chamber in which the object is stored.

In addition, the present disclosure is to provide an object treating apparatus in which a first flow channel circulating in a first chamber and a second flow channel formed as a closed circulation flow channel for regenerating a porous material commonly flow in circulating means inside a second chamber.

In addition, the present disclosure is to provide an object treating apparatus that selectively switches one of a first flow channel and a second flow channel via circulating means.

In addition, the present disclosure is to provide an object treating apparatus in which objects such as laundry or items are stored in a space-efficient manner as a shelf is detachably disposed in a first chamber.

In addition, the present disclosure is to provide an object treating apparatus that allows air to circulate uniformly by changing an arrangement of an air discharge port defined inside a showcase space and a storage space even when a shelf is disposed.

In addition, the present disclosure is to provide an object treating apparatus constructed such that a porous material may be withdrawn out of a cabinet and replaced.

In addition, the present disclosure is to allow an object accommodated inside a showcase space to be exposed to the outside based on an intention or a purpose of a user via a door window disposed on a cabinet front surface.

In addition, the present disclosure is to provide an object treating apparatus equipped with a lighting inside of a first chamber and on a shelf to maximize an aesthetic effect when viewed from the outside.

According to an aspect of the present disclosure, provided is an object treating apparatus including a cabinet equipped with an inlet defined in a front surface, a door coupled to the cabinet so as to open and close the inlet, a first chamber located inside the cabinet and accommodating therein an object input via the inlet, a second chamber located inside the cabinet and defining therein a space separated from the first chamber, and circulating means positioned inside the second chamber so as to circulate air in the first chamber, wherein the circulating means includes a connection duct equipped with a blowing fan for circulating air and air treating means for treating air, a first flow channel including the connection duct and in communication with the first chamber so as to circulate air in the first chamber, and a second flow channel disposed in the first chamber, including the connection duct, and circulating air in the connection duct during a regeneration process of the air treating means.

In one implementation, the air treating means may dehumidify or filter air flowing in the connection duct.

In one implementation, the circulating means may further include a flow channel switching portion for selectively allowing one of the first flow channel and the second flow channel to be in communication with the connection duct.

In one implementation, the flow channel switching portion may include a first switching portion disposed upstream of the connection duct based on air flowing in the circulating means so as to allow the first flow channel to be in communication with the connection duct or block the first flow channel from the connection duct.

In one implementation, the flow channel switching portion may include a second switching portion disposed downstream of the connection duct so as to allow the connection duct to be in communication with one of the first flow channel and the second flow channel.

In one implementation, the object treating apparatus may further include a controller that controls the flow channel switching portion to perform a circulation mode where the first switching portion allows the first flow channel to be in communication with the connection duct and the second switching portion allows the connection duct to be in communication with the first flow channel, and perform a regeneration mode where the first switching portion blocks the first flow channel from the connection duct and the second switching portion allows the connection duct to be in communication with the second flow channel.

In one implementation, the object treating apparatus may further include heating means disposed upstream of the air treating means based on air flowing inside the connection duct and heating air, and the controller may control the circulating means to stop the heating means in the circulation mode and to operate the heating means in the regeneration mode.

In one implementation, the circulating means may be constructed such that the first flow channel and the second flow channel diverge downstream of the connection duct based on air flowing inside.

In one implementation, the connection duct may include an inlet hole defined therein for air of the first chamber to be introduced, and the inlet hole may be defined to face the blowing fan.

In one implementation, the connection duct may further include heating means for heating air, and the air treating means may be disposed downstream of the heating means based on air flowing in the circulating means, so that air heated by the heating means during the regeneration process may be introduced into the air treating means.

In one implementation, the second flow channel may include a regeneration duct where air of the connection duct circulates in the second chamber and at least partially in contact with an inner surface of the cabinet.

In one implementation, the heating means may be disposed closer to the air treating means among the air treating means and the blowing fan.

In one implementation, the object treating apparatus may further include an air port allowing the first chamber to be in communication with the connection duct and disposed closer to a rear surface of the first chamber among the inlet and the rear surface of the first chamber.

In one implementation, the second chamber may be disposed beneath the first chamber, and the air port may include an air intake port defined in a bottom surface of the first chamber, wherein air in the first chamber flows into the connection duct via the air intake port, and an air discharge port defined in the bottom surface of the first chamber so as to be spaced apart from the air intake port in a width direction of the first chamber, wherein air is discharged into the first chamber via the air discharge port.

In one implementation, the connection duct may further include a replacement body for the air treating means to be coupled in a detachable manner, wherein the replacement body is extendable to the outside of the cabinet.

In one implementation, the cabinet may include a replacement hole defined therein for the replacement body to be extended, and the replacement body includes a seating surface for the air treating means to be seated, and a separation panel disposed to fill the replacement hole to form at least a portion of the cabinet, and is extendable out of the cabinet via the replacement hole.

In one implementation, the door may include a first door body for opening and closing a portion of the inlet, and a second door body disposed beneath the first door body and opening and closing the remaining portion of the inlet.

The present disclosure has the effect of providing the object treating apparatus equipped with the first chamber for displaying the object outside while storing the object under the environmental conditions suitable for the object, and the second chamber in which the air is treated separately from the first chamber.

In addition, the present disclosure has the effect of providing the object treating apparatus capable of reducing the volume of the second chamber as the porous material that performs one or more functions of the air dehumidification and filtration is disposed inside the second chamber separated from the first chamber, compared to the case in which the heat pump is disposed in the second chamber.

In addition, the present disclosure has the effect of providing the object treating apparatus separately including the flow channel for regenerating the saturated and adsorbed porous material via the closed circulation flow channel disposed inside the second chamber, and the flow channel circulating in the first chamber in which the object is stored.

In addition, the present disclosure has the effect of providing the object treating apparatus in which the first flow channel circulating in the first chamber and the second flow channel formed as the closed circulation flow channel for regenerating the porous material commonly flow in the circulating means inside the second chamber.

In addition, the present disclosure has the effect of providing the object treating apparatus that selectively switches one of the first flow channel and the second flow channel via the circulating means.

In addition, the present disclosure has the effect of providing the object treating apparatus in which the objects such as the laundry or the items are stored in the space-efficient manner as the shelf is detachably disposed in the first chamber.

In addition, the present disclosure has the effect of providing the object treating apparatus that allows the air to circulate uniformly by changing the arrangement of the air discharge port defined inside the showcase space and the storage space even when the shelf is disposed.

In addition, the present disclosure has the effect of providing the object treating apparatus constructed such that the porous material may be withdrawn out of the cabinet and replaced.

In addition, the present disclosure has the effect of allowing the object accommodated inside the showcase space to be exposed to the outside based on the intention or the purpose of the user via the door window disposed on the cabinet front surface.

In addition, the present disclosure has the effect of providing the object treating apparatus equipped with the lighting inside of the first chamber and on the shelf to maximize the aesthetic effect when viewed from the outside.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Specific terms used herein are only for convenience of description and are not used as a limitation of the illustrated embodiment.

For example, expressions indicating that things are in the same state, such as "same", "equal", "homogeneous", and the like, not only indicate strictly the same state, but also indicate a state in which a tolerance or a difference in a degree to which the same function is obtained exists.

For example, expressions indicating a relative or absolute arrangement such as "in a certain direction", "along a certain direction", "parallel", "orthogonal", "central", "concentric", "coaxial", or the like not only strictly indicate such arrangement, but also indicate a state in which a relative displacement is achieved with a tolerance, or an angle or a distance that achieves the same function.

In order to describe the present disclosure, the description below will be achieved on the basis of a spatial orthogonal coordinate system with an X-axis, a Y-axis, and a Z-axis orthogonal to each other. Each axial direction (an X-axis direction, a Y-axis direction, or a Z-axis direction) means both directions in which each axis extends. Adding a '+' sign in front of each axial direction (a +X-axis direction, a +Y-axis direction, or a +Z-axis direction) means a positive direction, which is one of the two directions in which each axis extends. Adding a '−' sign in front of each axial direction (a −X-axis direction, a −Y-axis direction, or a −Z-axis direction) means a negative direction, which is the other of the two directions in which each axis extends.

Expressions referring to directions such as "front (+Y)/rear (−Y)/left (+X)/right (−X)/up (+Z)/down (−Z)" to be mentioned below are defined based on a XYZ coordinate axis. However, this is to describe the present disclosure such that the present disclosure may be clearly understood. In one example, each direction may be defined differently depending on the standard.

The use of terms such as 'first, second, third' in front of the components to be mentioned below is only to avoid confusion of the components referred to, and is independent of the order, importance, or master-slave relationship between the components. For example, an invention including only the second component without the first component may also be implemented.

As used herein, singular expressions include plural expression unless the context clearly indicates otherwise.

In the present document, a term "object" is a concept including all normal laundry that requires usual management, such as a top, such as a dress shirt or blouse, a bottom, such as jeans, and a suit, a jumper, or leather clothes. In addition, in the present document, the object is used as an encompassing concept that includes items, such as a hat, a scarf, a handkerchief, a bag, or a doll, and things, such as a watch and an accessory, excluding the normal laundry. However, in the present document, even when only one of the words laundry, articles, and things is used, it may be interpreted as referring to the object in the context of the present document.

In other words, in the present document, the term object may be understood to include any object that may be accommodated in an object treating apparatus according to one embodiment of the present disclosure without being defined by classification of the articles such as the laundry, the items, and the things.

In addition, in the present document, treating the object means managing a temperature or a humidity of a space in which the object is stored, deodorizing, or filtering contaminants in air.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An object treating apparatus comprising:

a cabinet having an inlet defined in a front surface;

a door coupled to the cabinet so as to open or close the inlet;

a first chamber located inside the cabinet to receive therein an object placed through the inlet;

a second chamber located inside the cabinet and defining therein a space separated from the first chamber;

a connection duct provided in the second chamber and having at least one inlet hole configured to communicate with the first chamber and an outlet hole configured to communicate with the first chamber; and an air handler provided in the connection duct, the air handler having an impeller driven by a motor to draw air from the at least one inlet hole and discharge air to the outlet hole, wherein the at least one inlet hole and the outlet hole is selectively opened or closed such that a first air flow channel is formed to circulate air between the first chamber and the connection duct of the second chamber and a second air flow channel is formed to recirculate air in the connection duct of the second chamber.

2. The object treating apparatus of claim 1, wherein air handler further includes a filter to remove at least one of particles or moisture in air flowing in the connection duct.

3. The object treating apparatus of claim 2, wherein the air handler further includes a heater to heat air, and the filter is provided to receive air heated by heater.

4. The object treating apparatus of claim 3, further comprising a regeneration duct communicates with the connection duct and at least partially in contact with the inner surface of the cabinet, the second air flow channel flows between the regeneration duct and the connection duct.

5. The object treating apparatus of claim 3, wherein the heater is disposed closer to the filter than the impeller.

6. The object treating apparatus of claim 2, wherein the connection duct further includes a replacement body configured to house the filter and configured to be for the extend out of the cabinet.

7. The object treating apparatus of claim 6, wherein the cabinet includes a replacement hole defined therein for the replacement body to be extended, wherein the replacement body includes a drawer having a seating surface for the filter to be seated and extending out of the cabinet via the replacement hole.

8. The object treating apparatus of claim 1, wherein connection duct further includes at least one flow valve for selectively switching between the first air flow channel and the second air flow channel.

9. The object treating apparatus of claim 8, wherein the at least one flow valve includes a first valve disposed upstream of the impeller to allow the first flow channel to circulate air between the connection duct and the first chamber.

10. The object treating apparatus of claim 9, wherein the at least one flow valve further includes a second valve disposed downstream impeller to block the first air flow channel to the discharge port and the second air flow channel to be formed to recirculate or regenerate the air to the connection duct.

11. The object treating apparatus of claim 10, further comprising:

a controller configured to control the first and second valves to perform a circulation mode where the first flow channel is formed between the first chamber and the connection duct, and to perform a regeneration mode where air flowing out of the outlet hole is redirected to the at least one inlet hole to form the second flow channel.

12. The object treating apparatus of claim 11, wherein the air handler further comprises a heater to heat air within the connection duct, and the controller is configured to turn off the heater in the circulation mode and to turn on the heater in the regeneration mode.

13. The object treating apparatus of claim 1, wherein the first flow channel and the second flow channel diverge downstream of the connection duct.

14. The object treating apparatus of claim 1, wherein the inlet hole is defined to face the impeller.

15. The object treating apparatus of claim 1, further comprising an air port allowing the first chamber to be in communication with the connection duct and disposed closer to a rear surface of the first chamber than the inlet of the first chamber.

16. The object treating apparatus of claim 15, wherein the second chamber is disposed beneath the first chamber, wherein the air port includes:

an air intake port defined in a bottom surface of the first chamber and configured to communicate with the at least one inlet hole, wherein air in the first chamber flows into the connection duct via the air intake port; and an air discharge port defined in the bottom surface of the first chamber to be spaced apart from the air intake port in a width direction of the first chamber and configured to communicate with the outlet hole, wherein air is discharged from the connection duct into the first chamber via the air discharge port.

17. The object treating apparatus of claim 1, wherein the door includes:

a first door body for opening and closing a portion of the inlet; and a second door body disposed beneath the first door body and opening and closing the remaining portion of the inlet.

18. The object treating apparatus of claim 1, wherein the at least one inlet hole comprises a first inlet hole and a second inlet hole, the first inlet hole is configured to communicate with the first chamber for the first air flow channel, and the second inlet hole is configured to communicate with the outlet hole for the second air flow channel.

19. The object treating apparatus of claim 18, further comprising:

a return duct provided between the outlet hole and the second inlet hole;

a first diverter or damper configured to open or close the first inlet hole; and a second diverter or damper provided at the outlet and configured direct air to the first chamber for the first air flow channel or redirect air to the second inlet hole to the connection duct through the return duct for the second air flow channel.

20. The object treating apparatus of claim 1, wherein the impeller driven by a motor is one of a fan, a blower or a compressor.

* * * * *